US007210649B2

(12) United States Patent
Yu Chen

(10) Patent No.: US 7,210,649 B2
(45) Date of Patent: May 1, 2007

(54) MEMBRANE PACKING DISPENSER

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 180 days.

(21) Appl. No.: 11/113,238

(22) Filed: Apr. 25, 2005

(65) Prior Publication Data

US 2006/0237577 A1 Oct. 26, 2006

(51) Int. Cl.
*B65H 16/04* (2006.01)

(52) U.S. Cl. ..... 242/588.2; 242/405.3; 242/407; 242/571.5; 242/612

(58) Field of Classification Search ..... 242/405, 242/405.3, 405.1, 405.2, 604, 118, 571, 571.3, 242/571.4, 571.5, 588, 588.2, 613, 613.1, 242/613.2, 129, 407, 129.5, 130, 130.4, 612, 242/599, 599.4, 611, 597.3, 597.5, 597.6, 242/577, 577.1, 577.3, 596.7, 422.4, 422.9
See application file for complete search history.

(56) References Cited

U.S. PATENT DOCUMENTS 5,915,642 A * 6/1999 Davis ..... 242/422.4
6,227,480 B1 * 5/2001 Huang ..... 242/588.2
6,478,248 B2 * 11/2002 Liu ..... 242/571.4
6,619,581 B2 * 9/2003 Liu ..... 242/571.4
6,892,975 B2 * 5/2005 Yu Chen ..... 242/422.4

* cited by examiner

*Primary Examiner*—Patrick Mackey
*Assistant Examiner*—William E. Dondero
(74) *Attorney, Agent, or Firm*—Troxell Law Office, PLLC

(57) ABSTRACT

A membrane packing dispenser includes a rotary shaft sleeve and a holding sleeve. The cylindrical portion of the rotary shaft sleeve is step-shaped and formed with a lower portion to be fitted with a membrane reel and an upper portion for receiving the cylindrical portion of the holding sleeve. The lower portion of the rotary shaft sleeve has its outer wall bored with plural slots respectively disposed therein with a tightening plate having its upper opposite sides respectively fixed with an engage projection. Thus, the lower portion of the rotary shaft sleeve can be firmly engaged with the end of a membrane reel by the engage projections of the tightening plates. The engage projections can be elastically adjusted to shift; therefore, the rotary shaft sleeves are applicable to various membrane reels with a little difference in size.

6 Claims, 7 Drawing Sheets

MEMBRANE PACKING DISPENSER

BACKGROUND OF THE INVENTION

1. Field of the Invention

This invention relates to a membrane packing dispenser, particularly to one able to enlarge a holding space for facilitating holding and applicable to various membrane reels with a little difference in size.

2. Description of the Prior Art

A conventional membrane packing dispenser 10, as shown in FIG. 1, includes a holding sleeve 11 and a rotary shaft sleeve 12. The holding sleeve 11 is formed with a sleeve body 111 to be received in the sleeve body 121 of the rotary shaft sleeve 12 and has it s lower end firmly engaged with the lower end of the rotary shaft sleeve 12, enabling the rotary shaft sleeve 12 and the holding sleeve 11 to rotate relatively. The sleeve body 121 of the rotary shaft sleeve 12 has its outer wall surface provided with a plurality of elongate engage ribs 122 to be fixedly engaged with the inner walls of the shaft holes in the opposite ends of the central shaft tube of a membrane reel. Thus, a user's hands can get in the accommodating spaces of the sleeve bodies 11 of the two opposite holding sleeves 11 to rotate the holding sleeve 11 together with the rotary shaft sleeves 12 for releasing of the membrane of the membrane reel fitted on the two rotary shaft sleeves 12.

However, the diameter of the shaft tube of a common membrane reel is fixed in size; therefore, the outer diameter of the cylindrical body 121 of the rotary shaft sleeve 12 must agree with the inner diameter of the central shaft tube of the common membrane reel. Further, since the sleeve body 111 of the holding sleeve 11 is to be fitted in the interior of the cylindrical body 121 of the rotary shaft sleeve 12; therefore, the sleeve body 111 and the accommodating space 112 of the holding sleeve 11 are restricted in size. If the accommodating space 112 of the holding sleeve 11 is too narrow and small, a comparatively big palm can hardly get in the accommodating space for holding and may be hurt in case of operating forcefully. Furthermore, although the diameters of the shaft tubes of common membrane reels are fixed in size, yet there may be still a little error between them; therefore, it is hard to guarantee that every membrane reel can be firmly fitted with the engaged ribs 122 of the sleeve body 121 of the rotary shaft sleeve 12, likely to render the membrane reel unable to be fitted on the sleeve body 121 of the rotary shaft sleeve 12 or impossible to be secured tightly due to excessive slackness.

SUMMARY OF THE INVENTION

The objective of the invention is to offer a membrane packing dispenser including a holding sleeve and a rotary shaft sleeve. The cylindrical portion of the rotary shaft sleeve is step-shaped and formed with a lower portion to be fitted with a membrane reel and an upper portion for receiving the cylindrical portion of the holding sleeve therein. The lower portion has its outer wall bored with plural slots respectively disposed therein with a tightening plate having its upper opposite sides respectively fixed with an engage projection. The lower portion of the rotary shaft sleeve has its interior secured with a circular projection having plural support ribs extending outward from the outer edge and respectively connected with the intermediate portion of the tightening plate. The engage projections on the tightening plate are positioned a little higher than the outer wall surface of the lower portion. Thus, the lower portion of the rotary shaft sleeve can be firmly engaged with the inner walls of, the opposite ends of a membrane reel by means of the engage projections of the tightening plates. The engage projections of the tightening plates can be diametric ally pressed to shift elastically; therefore, the rotary shaft sleeves of the membrane packing dispenser in the present invention can be applied for various membrane reels with a little difference in size. In addition, matching with the upper portion of the rotary shaft sleeve, which has a comparatively large diameter, the holding sleeve to be fitted in the upper portion of the rotary shaft sleeve can be formed with a comparatively large accommodating space for facilitating a user's hand to extend therein for holding.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
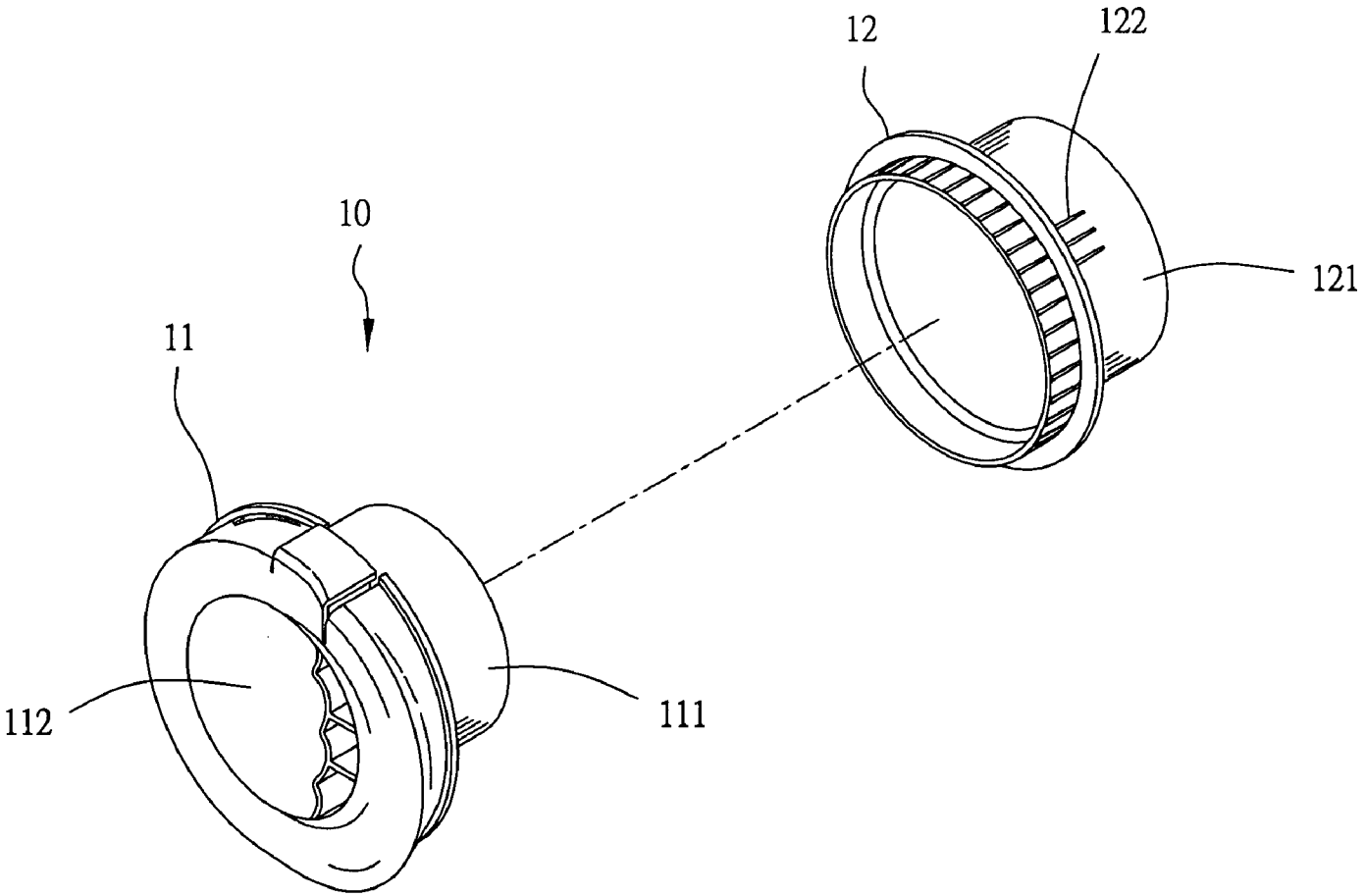
FIG.1 PRIOR ART
FIG. 1 is an exploded perspective view of a conventional membrane packing dispenser.
Figure 2:
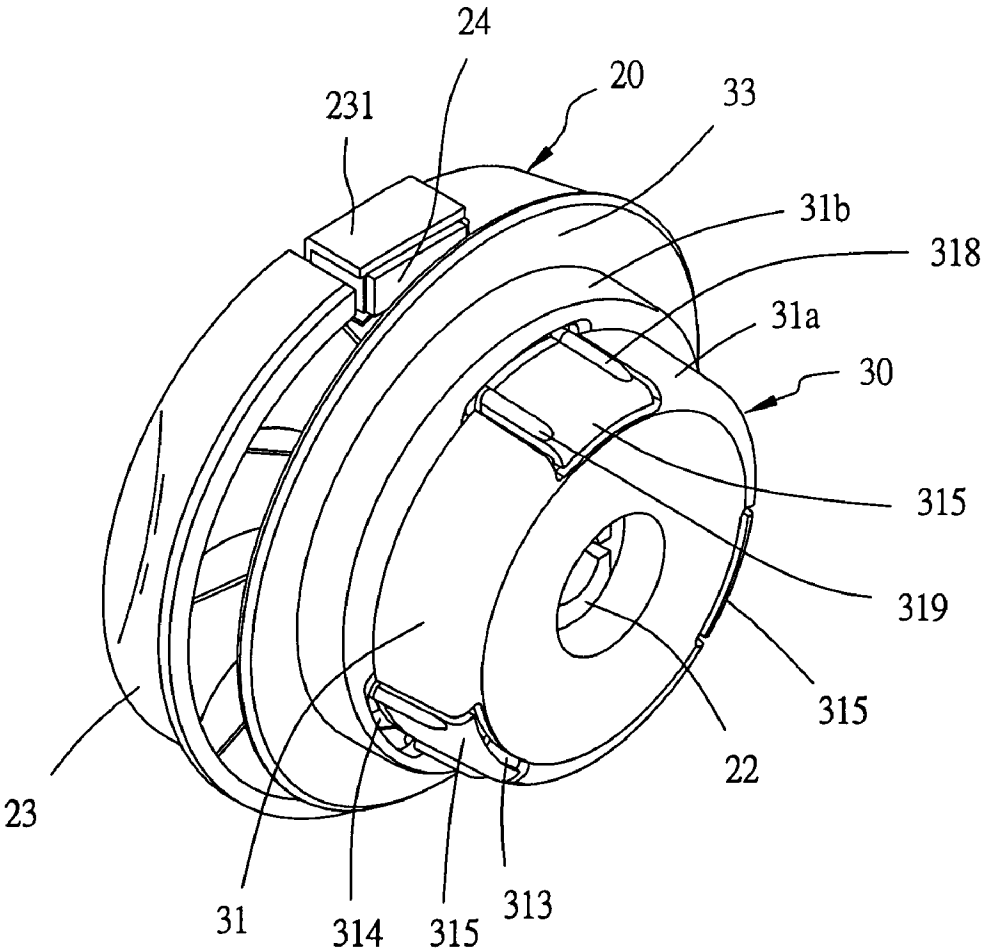
FIG. 2 is a perspective view of a membrane packing dispenser in the present invention.
Figure 3:
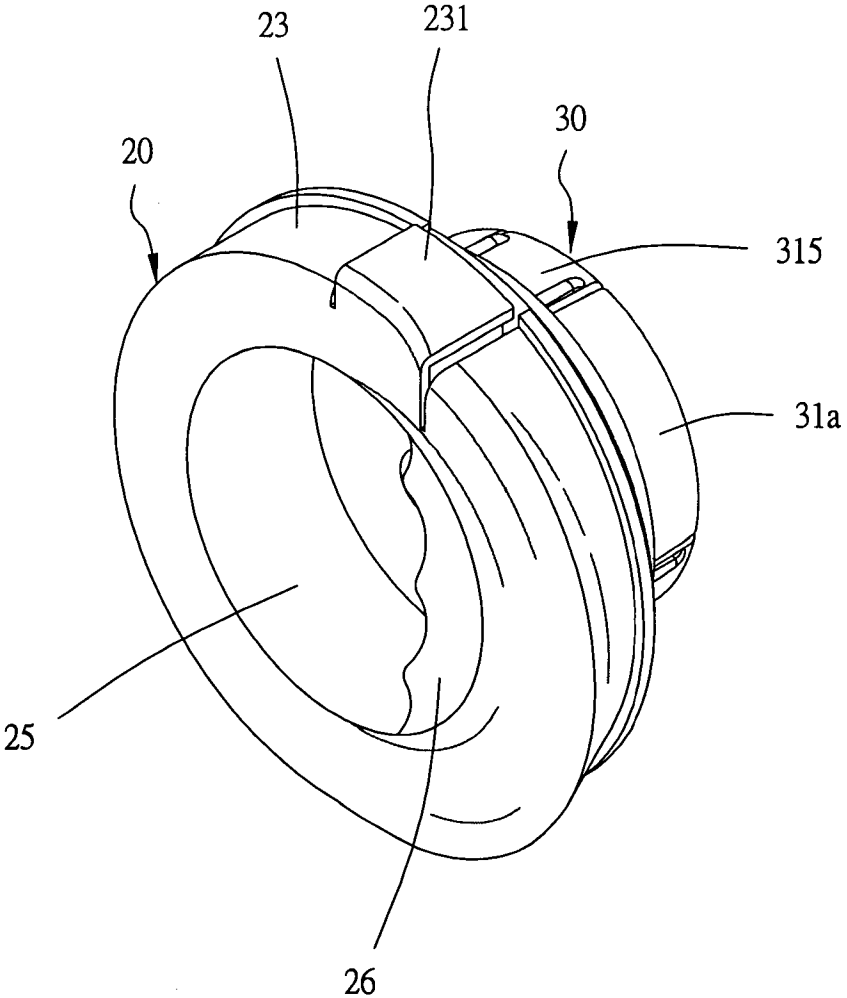
FIG. 3 is another perspective view of the membrane packing dispenser in the present invention.
Figure 4:
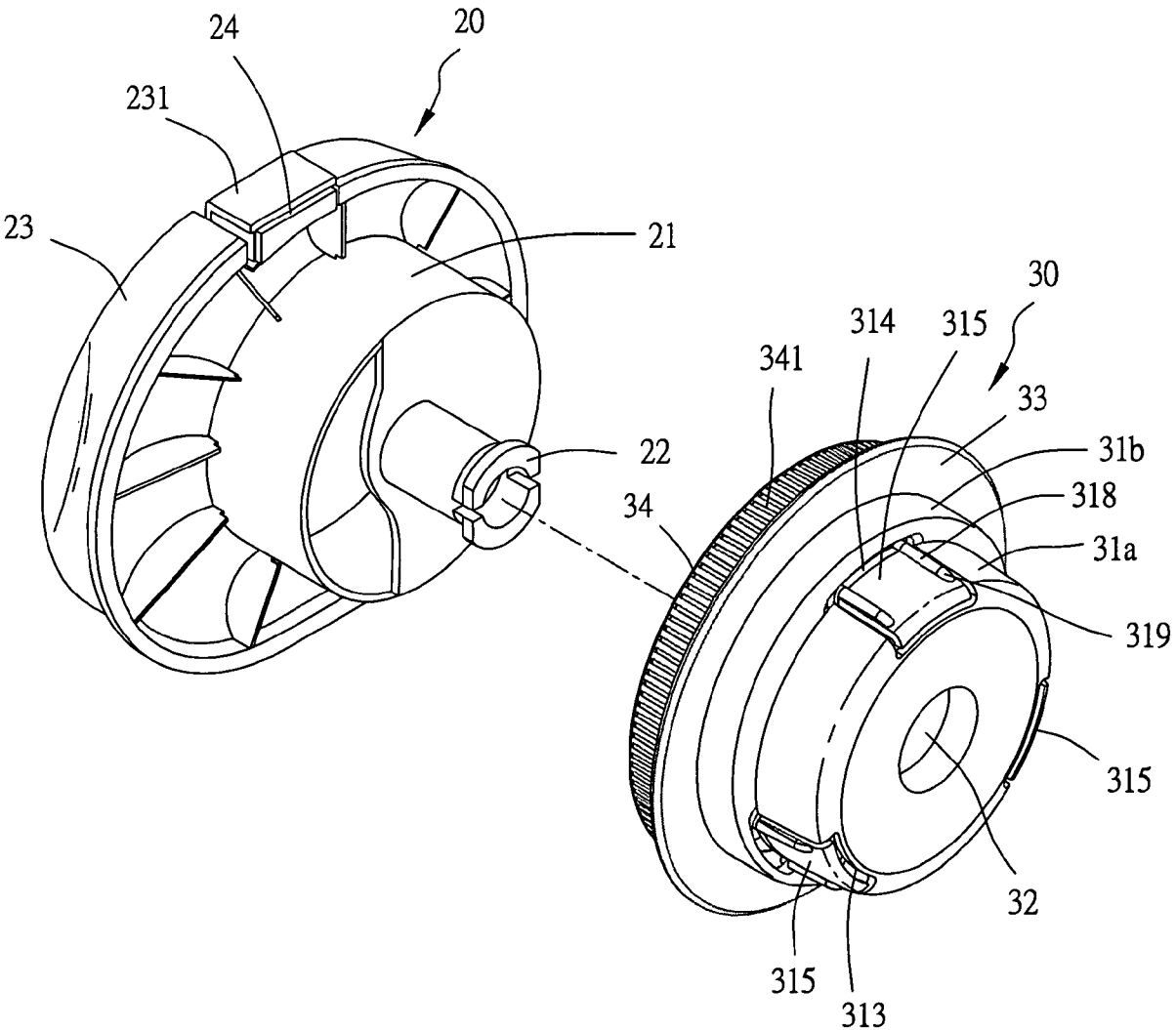
FIG. 4 is a partial exploded perspective view of the membrane packing dispenser in the present invention.
Figure 5:
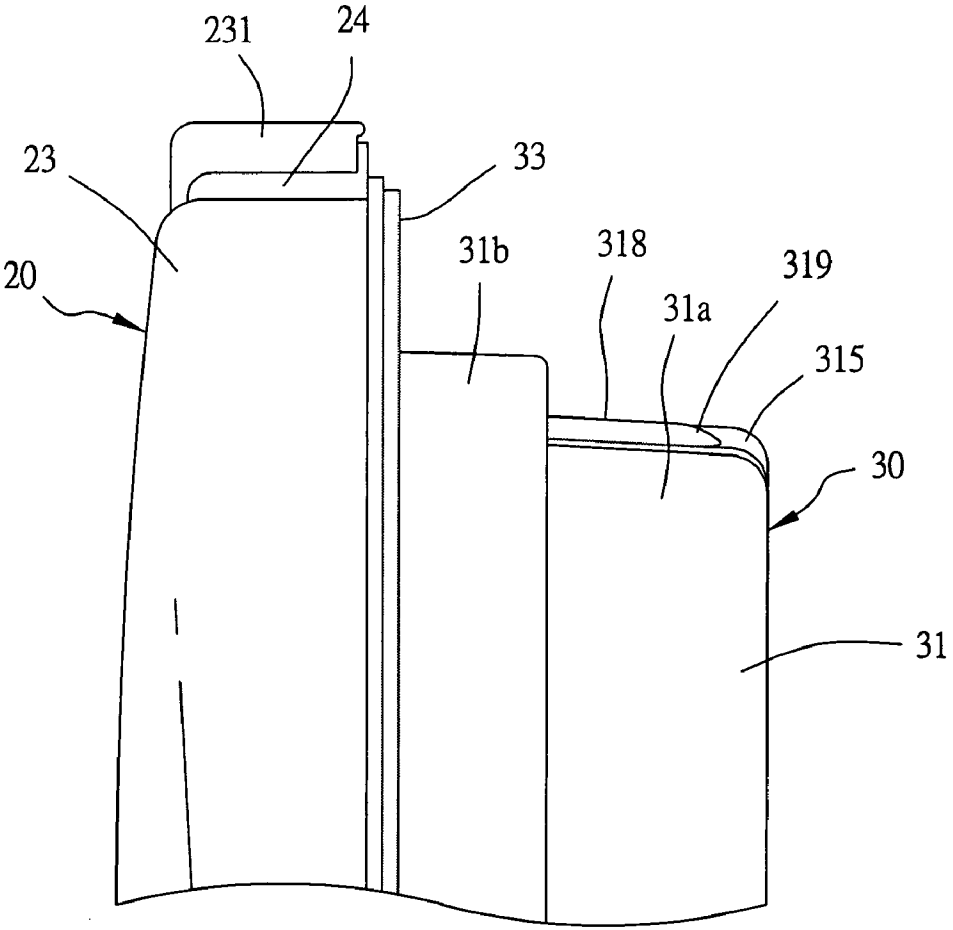
FIG. 5 is a partial side-sectional view of the membrane packing dispenser in the present invention.
Figure 6:
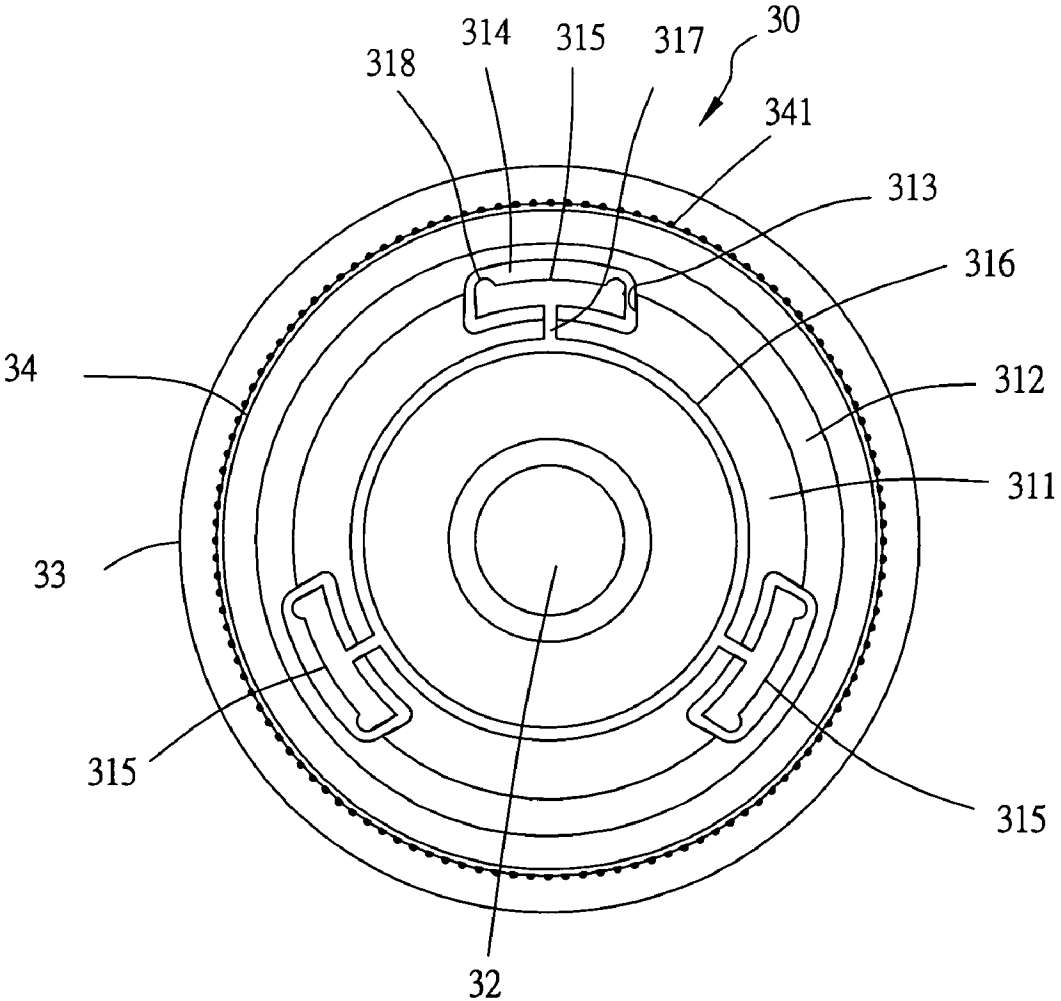
FIG. 6 is a cross-sectional view of the inner structure of a rotary shaft sleeve in the present invention.

A preferred embodiment of a membrane packing dispenser in the present invention, as shown in FIGS. 2, 3 and 4, includes a holding sleeve 20 and a rotary shaft sleeve 30 combined together.

The rotary shaft sleeve 30 is formed with a cylindrical portion 31 for receiving and positioning the cylindrical portion 21 of the holding sleeve 20. The cylindrical portion 21 of the holding sleeve 20 has its lower end fixed with a projecting engage member 22 to be inserted and engaged in the shaft hole 32 in the lower end of the cylindrical body 31 of the rotary shaft sleeve 30 to enable the holding sleeve 20 and the rotary shaft sleeve 30 to rotate together for releasing of a membrane. The cylindrical portion 31 of the rotary shaft sleeve 30 has its outer side edge extending upward diametrically and forming a circular stopping wall 33 and an annular projecting wall 34 extending forward and having its outer circumferential surface formed with numerous slide-stopping lines 341. The cylindrical portion 21 of the holding sleeve 20 has its outer side edge extending outward and then bent reversely to form a lip-shaped rim 23 to be properly covered around the circular projection 34 of the rotary shaft sleeve 30. A press member 231 able to be diametrically and elastically pressed is provided at a proper location of the lip-shaped rim 23, and a frictional block 24 is secured under the press member 231 to be moved downward together with the press member 231 and pressed on the slide-stopping lines 341 of the circular projection 34 of the rotary shaft sleeve 30 for stopping the rotary shaft sleeve 30 from rotating. The sleeve body 21 of the holding sleeve 20 has its interior formed with an accommodating space 25 for an operator's hand to extend therein, and a holding member 26 is formed in the accommodating space 25 for the operator to hold thereon.

In addition, the cylindrical portion 31 of the rotary shaft sleeve 30 is step-shaped and formed with a lower portion 31*a* and an upper portion 31*b*. The lower portion 31*a* has its interior formed with a recessed groove 311 with a comparatively small diameter, while the upper portion 31*b* has its interior formed with an accommodating space 312 with a comparatively large diameter for receiving therein the cylindrical portion 21 of the holding sleeve 20. The lower portion 31*a* of the rotary shaft sleeve 30 has its side wall and a part of the bottom bored with three slots 313 spaced apart equidistantly at proper locations, while the upper portion 31*b* ha s its longitudinal circular wall connected with the lower portion 31*a* bored with three insert grooves 314 respectively communicating with the three slots 313, with a tightening plate 315 inserted in each slot 313 and the insert groove 314. The recessed groove 311 of the rotary shaft sleeve 30 has its lower side formed integral with a circular projection 316 having three bar-shaped support ribs 317 extending outward diametrically from the outer circumferential wall, spaced apart equidistantly and respectively connected with the intermediate portions of the tightening plates 315. Additionally, each tightening plate 315 has its upper opposite sides respectively fixed with an elongate engage projection 318 positioned a little higher than the outer surface of the lower portion 31*a* and able to be diametrically pressed to shift elastically. Each engage projection 318 is formed with an arc-shaped upper edge and has its inserting end formed with a conical surface 319 having function of guiding.

Figure 7:
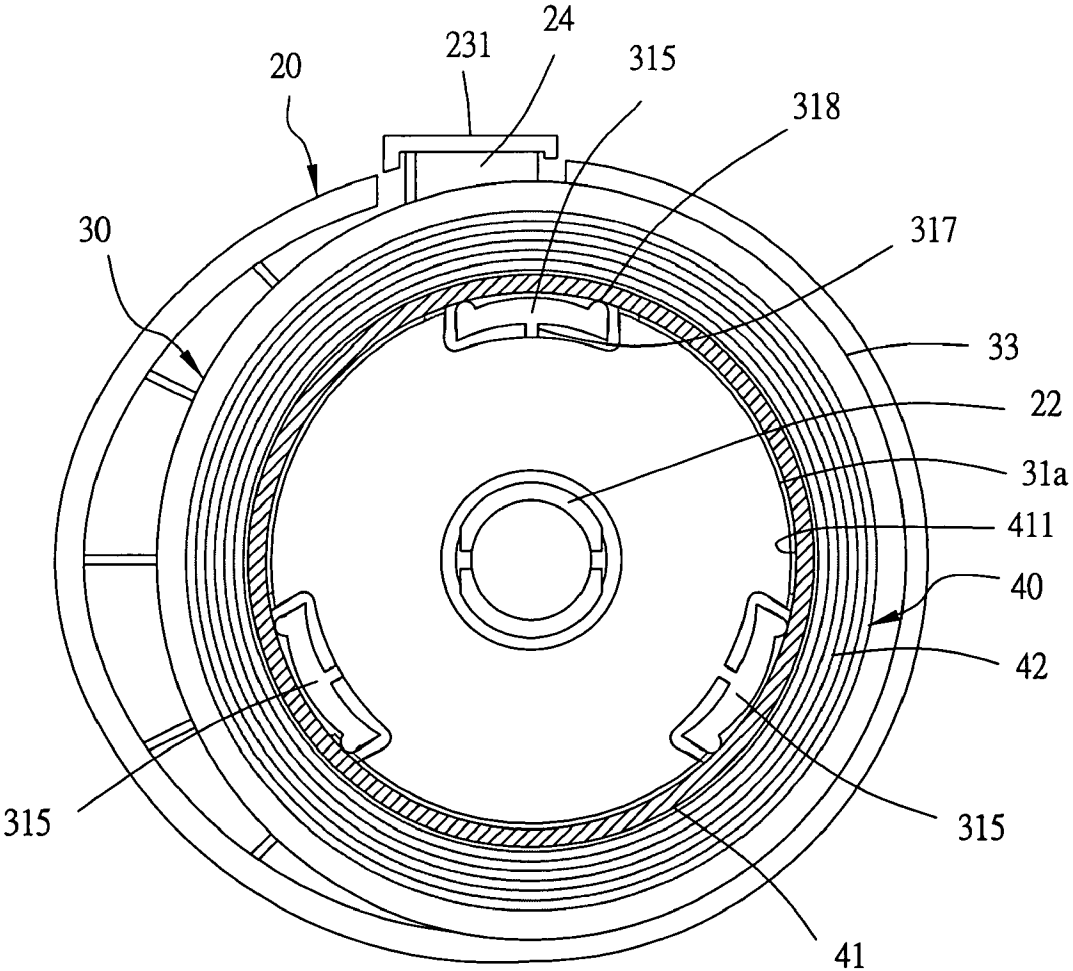
FIG. 7 is a cross-sectional view of membrane packing dispenser having the rotary shaft sleeve fitted with a membrane reel in the present invention.

In using, as shown in FIG. 7, firstly, the lower portion 31*a* of the rotary shaft sleeves 30 of a dispenser is aligned to the shaft hole 411 of the central shaft tube 41 of a membrane reel 40. Then, the lower portion 31*a* of the rotary shaft sleeve 30 is guided by the conical surfaces 319 at the inserting ends of the engage projections 318 and inserted in the shaft hole 411. Since the engage projections 318 of the tightening plates 315 can be diametrically and flexibly shifted, they can be inserted in the shaft hole 411 with a little difference in size. The engage projections 318 of the tightening plates 315 can be firmly engaged with the inner wall of the shaft hole 411 of the central shaft tube 41 of the membrane reel 40 to avoid sliding between them and enable the membrane reel 40 to rotate together with the rotary shaft sleeve 30 and to let the membrane 42 released out.

Specifically, the lower portion 31*a* of the rotary shaft sleeve 30 of the membrane packing dispenser of this invention is fixed on the outer surface with plural tightening plates 315 able to be shifted elastically; therefore, even if the shaft holes 411 of various membrane reels 40 are a little different in size, they still can be firmly fitted with the lower portion 31*a* of the rotary shaft sleeve 30 by means of the tightening plates 315 that can be elastically adjusted in position, elevating applicability of the membrane packing dispenser.

In addition, the cylindrical body 31 of the rotary shaft sleeve 30, is step-shaped and formed with the lower portion 3*a* and the upper portion 31*b*; therefore, the lower portion 31*a* of the sleeve body 31 with a comparatively small diameter can be fitted with a membrane reel 40, while the upper portion 31*b* with a comparatively large diameter can receive and position the cylindrical portion 21 of the holding sleeve 20 therein. Thus, matching with the upper portion 31*b* of the rotary shaft sleeve 30, which has a comparatively large diameter, the cylindrical portion 21 of the holding sleeve 20 can be formed with a comparatively large accommodating space 25 for a comparatively big hand to extend therein conveniently and clasp the holding member 26 smoothly, having excellent effects in holding and operating.

While the preferred embodiment of the invention has been described above, it will be recognized and understood that various modifications may be made therein and the appended claims are intended to cover all such modifications that may fall within the spirit and scope of the invention.

I claim:

1. A membrane packing dispenser comprising a holding sleeve and a rotary shaft sleeve for fitting a membrane reel, said rotary shaft sleeve formed with a cylindrical portion for receiving and positioning a cylindrical portion of said holding sleeve, said cylindrical portion of said holding sleeve having its lower end provided with an engage member, said engage member inserted and engaged in a shaft hole bored in the lower end of said cylindrical portion of said rotary shaft sleeve, said holding sleeve able to rotate together with said rotary shaft sleeve for releasing a membrane:

Said cylindrical portion of said rotary shaft sleeve having its outer wall bored with at least one slot, said slot fitted therein with a tightening plate, said tightening plate having a preset portion connected with a support rib, said support rib formed integral with said cylindrical portion of said rotary shaft sleeve and extending outward, said tightening plates properly protruding out of the outer wall surface of said cylindrical portion of said rotary shaft sleeve, said tightening plate able to be diametrically pressed and shifted elastically, said tightening plates firmly engaged with the inner wall of the opposite end shaft holes of a membrane reel fitted on said cylindrical portion of said rotary shaft sleeve, said tightening plates able to be elastically shifted and enabling said rotary shaft sleeves to be firmly fitted with various membrane reels with a little difference in size.

2. The membrane packing dispenser as claimed in claim 1, wherein said cylindrical portion of said rotary shaft sleeve is step-shaped, and formed with a lower portion and an upper portion, said lower portion having its interior formed with a recessed groove with a comparatively small diameter, said upper portion having its interior formed with an accommodating space with a comparatively large diameter, said support ribs extending outward diametrically from said recessed groove of said lower portion of said rotary shaft sleeve, said support ribs respectively connected with the intermediate portion of the inner side of said tightening plate, said accommodating space of said upper portion receiving therein said cylindrical portion of said holding sleeve.

3. The membrane packing dispenser as claimed in claim 2, wherein each said slot is bored in the side wall and a part of the bottom of said lower portion, and the longitudinal circular wall connected between said upper portion and said lower portion has plural insert grooves respectively communicating with said slots for the corresponding ends of said tightening plates to be respectively inserted therein.

4. The membrane packing dispenser as claimed in claim 2, wherein each said tightening plate has its upper opposite sides respectively fixed with an engage projection positioned a little higher than the outer wall surface of said lower portion of said rotary shaft sleeve, said engage projections able to be diametrically pressed to shift elastically to be inserted and firmly engaged with the inner wall of said end shaft hole of said membrane reel, said engage projections of said tightening plate respectively formed with an arc-shaped upper edge, said engage projections of said tightening plate having their inserting ends respectively formed with a conical surface, said conical surfaces of said engage projections facilitating said tightening plates to be guided and inserted in said end shaft holes of said membrane reel.

5. The membrane packing dispenser as claimed in claim 2, wherein said recessed groove of said rotary shaft sleeve has its lower side formed integral with a circular projection, and said support ribs extend outward diametrically from the outer circumferential wall of said circular projection.

6. The membrane packing dispenser as claimed in claim 1, wherein said rotary shaft sleeve is provided with three tightening plates spaced apart equidistantly.

* * * * *